United States Patent [19]

Izaki

[11] 4,084,632

[45] Apr. 18, 1978

[54] APPLICATOR NOZZLE FOR USE IN CENTRIFUGAL CASTING

[75] Inventor: Hiroshi Izaki, Osaka, Japan

[73] Assignee: Kubota, Ltd., Osaka, Japan

[21] Appl. No.: 664,892

[22] Filed: Mar. 8, 1976

[51] Int. Cl.[2] ..... B22C 3/00; B22D 13/10

[52] U.S. Cl. ..... 164/72

[58] Field of Search ..... 164/72; 239/557

[56] References Cited

U.S. PATENT DOCUMENTS

| | | | |
|---|---|---|---|
| 598,873 | 2/1898 | Joy | 239/557 X |
| 2,399,606 | 4/1946 | Schuh et al. | 164/72 |
| 2,709,112 | 5/1955 | Curtice | 239/557 |
| 2,726,180 | 12/1955 | Stankey | 239/557 X |
| 2,853,755 | 9/1958 | Beyer | 164/72 |
| 3,456,712 | 7/1969 | Schuh | 164/72 |

FOREIGN PATENT DOCUMENTS

| | | | |
|---|---|---|---|
| 537,837 | 3/1957 | Canada | 164/72 |
| 510,843 | 10/1930 | Germany | 239/557 |

*Primary Examiner*—Francis S. Husar
*Assistant Examiner*—Kuang Y. Lin
*Attorney, Agent, or Firm*—Wenderoth, Lind & Ponack

[57] ABSTRACT

An applicator nozzle for applying a coating solution onto the molding surface of a metal mold for use in centrifugal casting. The applicator nozzle mounted on an applicator lance is provided, at its one end facing the molding surface, with a plurality of small nozzle openings which are arranged at a predetermined pitch to each other in the direction of movement of the lance into the metal mold, through which nozzle openings, a solution of coating material is emitted in solid rod-like form in such an amount as to be sufficient to complete mold coating in one way of the nozzle into the metal mold, thus producing mold coating free from an undesirable spiral pattern.

4 Claims, 18 Drawing Figures

APPLICATOR NOZZLE FOR USE IN CENTRIFUGAL CASTING

BACKGROUND OF THE INVENTION

The present invention relates to centrifugal casting and more particularly, to improvements in an applicator nozzle for mold coating and a method for applying coating material to a metal mold for use in centrifugal casting.

DESCRIPTION OF THE PRIOR ART

Commonly, in centrifugal casting, molten metal is poured into a metal mold which is kept rotating on a plurality of rotating rollers while the metal solidifies for bringing the metal in conformity with the shape of the mold through centrifugal force. In such a process, prior to pouring the molten metal into the metal mold, a coating material including a parting agent is applied onto the surface of the metal mold contacting the molten metal (referred to as molding surface hereinbelow) for the formation of mold coating on the molding surface. As shown in FIG. 1, in the above application of the coating material onto the molding surface, the coating material *c* in the form of a liquid is jetted onto the inner molding surface *ma* of the metal mold *m* supported for rotation on rotating rollers *ra* and *rb* through reciprocating movement at a constant speed in the direction of an arrow, of a lance or applicator *l* provided, at one end thereof, with a nozzle *n* and axially, reciprocatingly disposed in the metal mold *m* in spaced relation to the molding surface *ma*.

Conventionally, such an applicator nozzle *n* for the coating material *c* is provided, for example, with a slit *s* as shown in FIG. 2(*b*) axially formed in the surface *na* at one end of the nozzle *n* cut at an angle, through which slit *s*, the coating material or coating solution *c* is sprayed onto the molding surface *ma* (FIG. 1) to form the mold coating on the latter. In the conventional nozzle construction as described above, however, the jet stream of the coating material *c* discharged from the slit *s* of the nozzle *n* as shown in FIG. 2(*a*) tends to be thick at opposite ends of the slit *s*, with the central portion thereof being thin, especially when coating material of high viscosity is employed, thus making it impossible to obtain a stable spraying condition. In another type of conventional nozzle, the slit *s* as described above is replaced by a small discharge opening *s'* formed on the surface *na'* of the nozzle *n'* as shown in FIG. 3(*b*), even in which arrangement, however, coating material of high viscosity is not sprayed in the form of mist, but is discharged as drops of liquid in a solid rod-like stream *c'* as shown in FIG. 3(*a*). On the other hand, in cases where a relatively thick mold coating of approximately 3mm is to be formed with the use of the applicator nozzle *n* or *n'* as described above through several times of repeated coatings to obtain the desired thickness, since the coating solution of high viscosity is discharged not in a spray, but in a stream of uneven thickness of solid rod-like stream, drops of the coating solution subsequently discharged from the nozzle tend to dig up the mold coating applied earlier. This gives rise to the spiral pattern in the mold coating formed on the mold as shown in FIG. 4 which shows the surface of a casting produced through such mold coating.

Furthermore, in the conventional applicator nozzles of the above described type, when a nozzle is to be replaced with one corresponding to the running speed of the applicator lance *l* or with a new nozzle due to wearing-out of nozzle openings, it is necessary to remove the entire nozzle from the end of the lance for replacement. This arrangement is extremely uneconomical from in viewpoint of the costs involved in the application of the mold coating and consequently in the centrifugal casting. Additionally, since interiors of the conventional nozzles are not arranged to be readily accessible for cleaning purposes, such nozzles are undesirably discarded after use for a short period of use, which also brings about further increases in manufacturing costs.

SUMMARY OF THE INVENTION

Accordingly, an essential object of the present invention is to provide an applicator nozzle for mold coating for use in centrifugal casting which is capable of applying a uniform mold coating onto a metal mold without formation of any spiral pattern in the mold coating with substantial elimination of the disadvantages inherent in conventional nozzles.

Another important object of the present invention is to provide an applicator nozzle for mold coating of the above described type whose portion having nozzle openings is replaceable for economical use of the nozzle, with the interior of the nozzle being adapted to be readily accessible for cleaning purposes.

A further object of the present invention is to provide a method for applying coating material onto a metal mold for use in centrifugal casting through which method, mold coating free from any spiral pattern is applied to the mold even when a thick mold coating is to be formed with the use of a coating material of high viscosity.

A still further object of the present invention is to provide an applicator nozzle for mold coating for use in centrifugal casting which is stable in function and simple in construction and can be manufactured at low cost.

According to a preferred embodiment of the present invention, the applicator nozzle mounted on an applicator lance is provided, at its surface adjacent to one end thereof facing the molding surface, with a plurality of small nozzle openings which are arranged at a predetermined distance or pitch to each other in the direction of advance of the lance. Through such nozzle openings, a solution of coating material is emitted in solid rod-like form in the direction perpendicular to the molding surface in such an amount as is sufficient to complete mold coating in one way of the applicator nozzle at predetermined constant speed into the metal mold. By this arrangement, the disadvantages inherent in the conventional applicator nozzles such as digging-up of the preceding mold coating by drops of coating material subsequently applied are eliminated. The formation of a spiral pattern on the mold coating being is consequently prevented even when a thick mold coating is formed through employment of high viscosity coating material. Furthermore, the portion of the applicator nozzle having the nozzle openings is adapted to be replaceable, with interior of the nozzle being arranged to be readily accessible for cleaning purposes. Thus economical use of the applicator nozzle for a long period of time is possible.

DESCRIPTION OF DRAWINGS

These and other objects and features of the present invention will become apparent from the following description taken in conjunction with the preferred embodiment thereof with reference to the accompanying drawings in which.

DESCRIPTION OF THE PREFERRED EMBODIMENTS

Figure 1:
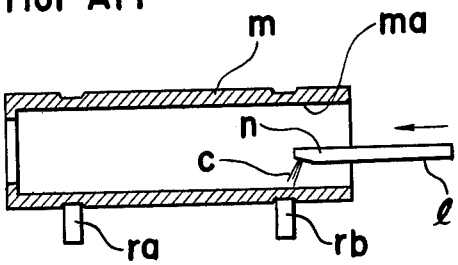
Prior Art FIG. 1
FIG. 1 is a schematic sectional view of a prior art casting device.
Figure 2A:
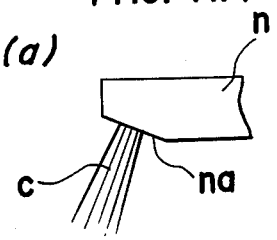
Prior Art FIG. 2(a)
FIGS. 2(*a*) and 2(*b*) represent a known prior art nozzle.
Figure 2B:
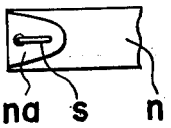

Before the description of the present invention proceeds, it is to be noted that like parts are designated by like reference numerals throughout several views of the attached drawings.

Figure 5:
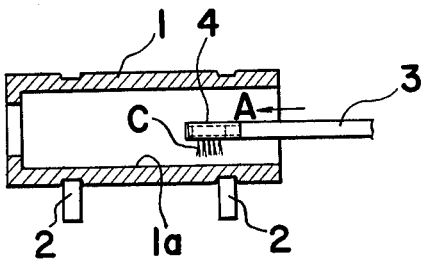
FIG. 5 is a schematic side sectional view explanatory of the application of the coating solution onto a molding surface of a metal mold with the use of an applicator nozzle according to the invention.
Figure 9:
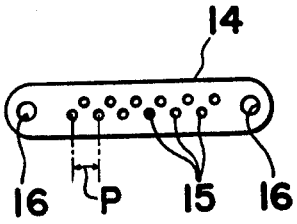
FIG. 9 is a top plan view, on an enlarged scale, of a nozzle plate member employed in the applicator nozzle of FIG. 6, FIG. 10(*a*) is a fragmentary side elevational view showing a modification of the applicator nozzle of FIG. 6, FIG. 10(*b*) is a front view of the applicator nozzle of FIG. 10(*a*), FIG. 10(*c*) is a similar view of FIG. 10(*a*), but particularly shows a cross section thereof, FIG. 10(*d*) is a similar view of FIG. 10(*b*), but particularly shows a cross section thereof.
Figure 10A:
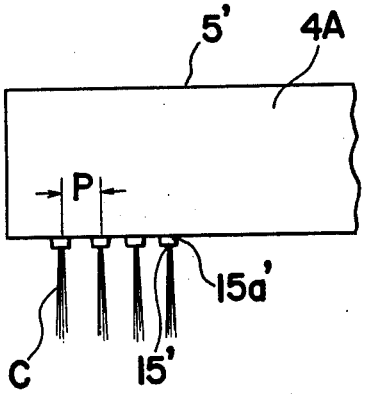
Figure 10B:
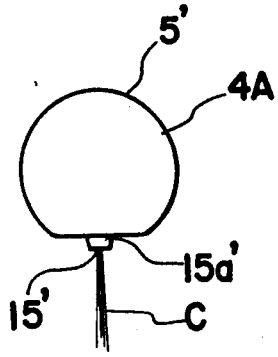
Figure 10C:
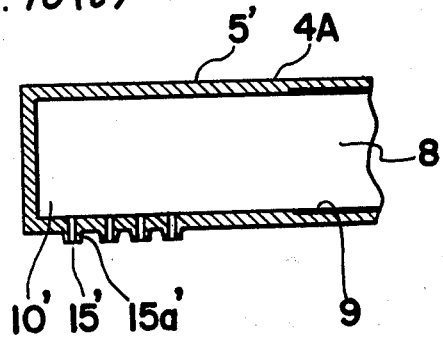
Figure 10D:
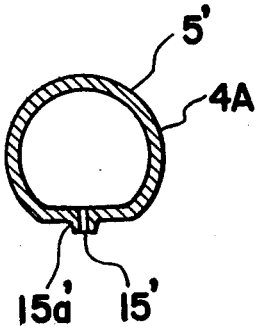

Referring now to FIGS. 5 to 9, there is shown in FIG. 5 an applicator nozzle 4 of the present invention which is mounted, in a manner as described later, on one end of an applicator lance 3 axially, reciprocatingly disposed in a centrifugal casting metal mold 1 which is rotatably mounted on rotating rollers 2, in spaced relation to a molding surface 1*a* of the metal mold 1 for applying coating material or coating solution C, onto the molding surface 1*a*, in a direction perpendicular to the surface 1*a* through nozzle openings (mentioned more in detail later) formed in the nozzle 4. More specifically, in FIGS. 6 to 8, the applicator nozzle 4 includes a main body 5 of cylindrical configuration whose inner passage 5*a* is eccentric with an outer periphery of the main body 5 as most clearly seen in FIG. 7 so as to provide a thick wall portion 5*b* therebetween. On the thick wall portion 5*b*, a flat surface 6 is formed, for example, by beveling. The flat surface 6 is further provided with an ellipsoidal recess 7 formed therein and having at the bottom thereof a smaller ellipsoidal or elongated opening 7*a* communicating with the inner passage 5*a* of the main body 5. Thus stepped portions 7*b* which are provided with threaded bores 13 are formed at opposite sides of the recess 7 as shown, while the inner surface of the passage 5*a* at one end 10 of the main body 5 is internally threaded, as at 11, to receive a corresponding externally threaded end of a plug 12. The inner surface of the passage 5*a* at the other end 8 of the main body 5 is also internally threaded, as at 9, for receiving a corresponding externally threaded end (not shown) of the lance 3. In FIG. 9, there is shown a nozzle plate 14 having a configuration exactly fitting into the ellipsoidal recess 7 of the main body 5. Such nozzle plate 14 is formed with a plurality of small nozzle openings 15 arranged, for example, in a zigzag manner at a predetermined distance or pitch P to each other for discharging the coating solution C in thin rod-like form therethrough, with openings 16 for securing screws being formed at opposite ends of the plate 14. It should be noted here that the nozzle plate 14 is not limited to the above described one kind, but may be prepared in several ways kinds having a common external dimension and being different in number, pitch and diameter of the nozzle openings 15 for replacement, depending on the moving speed of the lance 3. The nozzle plate 14 is described above is fitted into the recess 7 in such a manner that the directions of nozzle openings 15 thus aligned in the plate 14 are in agreement with the direction of movement of the lance 3 at a predetermined constant speed shown by an arrow A in FIG. 5, and is secured thereto by screws 17 screwed into the threaded bores 13 in the recess 7 through the openings 16 of the plate 14.

By the above arrangement, the applicator nozzle 4 screwed into the corresponding end (not shown) of the lance 3 is inserted into the metal mold 1 which is being rotated on the rotating rollers 2 and is moved from one end to the other end of said metal mold 1 at the predetermined constant speed in a one way direction of the arrow A in FIG. 5. The coating solution C is discharged from the nozzle openings 15 for applying the solution C onto the molding surface 1*a* of the metal mold 1, in which case, the coating solution C is jetted in the direction perpendicular to the molding surface 1*a* from each of the nozzle openings 15 in thin rod-like streams each having approximately equal thickness. Thus formation of thick and thin portions or a spiral pattern in the resultant mold coating, as experienced in the conventional nozzles having single slit, is eliminated, with the consequent formation of an even and uniform mold coating.

Furthermore, in the above described applicator nozzle 4 of the present invention, since the nozzle plate 14 formed with the plurality of nozzle openings 15 therein is prepared separately from the nozzle main body 5 for replaceable attachment thereof to the recess 7 of the main body 5, one nozzle main body 5 serves for common use through the mere replacement of one nozzle plate 14 according to the predetermined moving speed of the lance 3. Restoration of the nozzle 4 after nozzle openings 15 are worn out can readily be effected by simply replacing only the nozzle plate 14. The nozzle main body 5 is usable as it is in any of the above described replacements, thus contributing to an advantageous reduction of costs.

Additionally, it is another advantage of the applicator nozzle 4 of the present invention that since the inner surface of the passage 5*a* at the forward end 10 of the nozzle main body 5 is closed by the plug 12 releasably threaded thereinto, the interior of the nozzle main body 5 of the nozzle 4 is readily accessible for cleaning purposes by mere removal of the plug 12 therefrom. Such arrangement makes it possible to use the nozzle 4 very economically and in optimum condition for a long period of time. It should be noted here that the plug 12 described as employed in the above embodiment may be replaced by any ordinary covering member (not shown) so long as the same is releasably mounted on the main body 5 to close the end 10 thereof.

As is clear from the foregoing description, according to the applicator nozzle of the present invention, a stable mold coating of uniform thickness without formation of a spiral pattern is available through a simple arrangement wherein the nozzle plate having the plurality of small nozzle openings formed therein at the predetermined pitch in the direction of movement of the lance is releasably fitted into the corresponding recess. Such recess is formed at one portion on the outer periphery of the nozzle main body and communicates with the inner passage of the nozzle main body through the elongated opening, allowing economical use of the nozzle.

Figure 6:
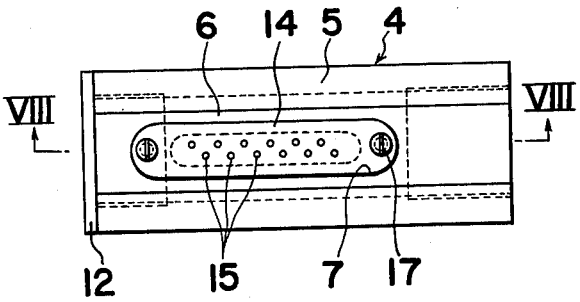
FIG. 6 is a top plan view, on an enlarged scale, of an applicator nozzle employed in the arrangement of FIG. 1.
Figure 7:
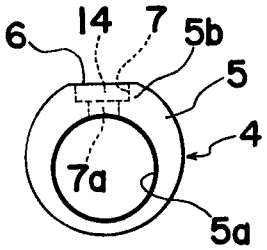
FIG. 7 is a front view of the applicator nozzle of FIG. 6.
Figure 8:
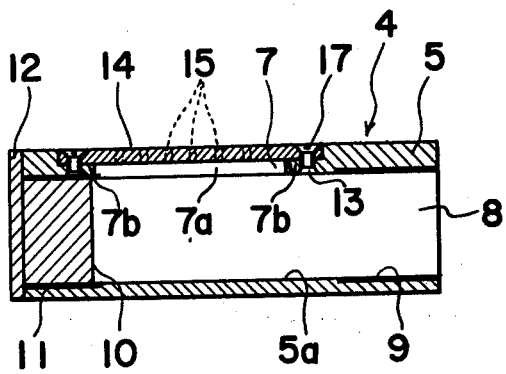
FIG. 8 is a cross sectional view taken along the line VIII — VIII of FIG. 6.

Referring now to FIGS. 10(*a*) to 10(*d*), there is shown a modification of the applicator nozzle of FIG. 6. In this modification, the nozzle plate 14 with the corresponding recess 7 and the elongate opening 7*a*, and the plug 12 described as employed in the nozzle 4 of FIGS. 6 to 9 are replaced by a plurality of nozzle openings 15' formed in corresponding projections 15*a'*. Such projections are axially arranged at a predetermined pitch to each other in the direction of the movement of the applicator lance 3 (FIG. 5) and integrally formed with the nozzle main body 5' of the applicator nozzle 4A, with the end 10' of the main body 5' being closed. The effect of the applicator nozzle 4A of FIGS. 10(*a*) to 10(*d*) in the formation of the mold coating is similar to that described with reference to the embodiment of FIGS. 6 to 9, so a detailed description thereof is abbreviated. It is to be noted here that the end 10' of the nozzle main body 5' described as closed in the modification of FIGS. 10(*a*) to 10(*d*) may be open for being closed by a releasable plug threaded thereinto in a similar manner as in the embodiment of FIGS. 6 to 9, in which case cleaning of the interior of the nozzle main body 5' is greatly facilitated.

As is seen from the foregoing description, according to the modification of FIGS. 10(*a*) to 10(*d*), the applicator nozzle 4A has a very simple construction, with the nozzle openings formed directly in the nozzle main body 5', thus requiring no particular machining in the manufacture thereof, and is yet scarcely affected, in its discharge of the coating solution, by the delivering pressure and viscosity of the coating solution. Thus, stable application of the coating solution onto the molding surface is advantageously achieved.

Figure 12A:
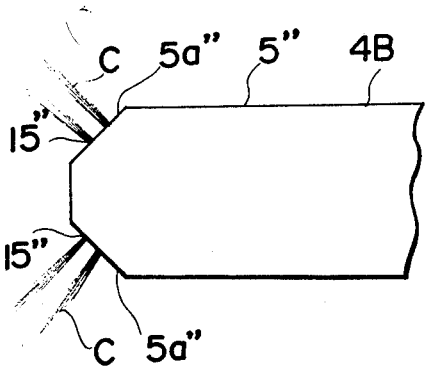
Figure 12B:
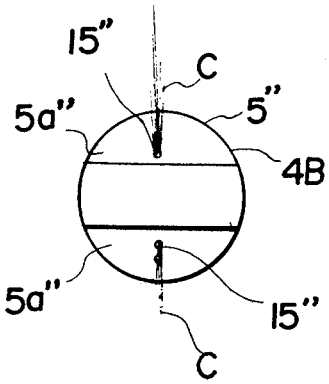

Referring to FIGS. 12(*a*) and 12(*b*), there is shown another modification of the applicator nozzle 4A of FIGS. 10(*a*) to 10(*d*). In this modification, the projections 15*a'* having nozzle openings 15 therein described as employed in the nozzle 4A of FIGS. 10(*a*) to 10(*d*) are dispensed with and the nozzle main body 5'' of the nozzle 4B has one end bevel-shaped to have a pair of flat faces 5*a''* which incline toward the longitudinal axis of said body 5'' at a predetermined angle in opposite relation, to each other. In each of the faces 5*a''*, there are formed a plurality of nozzle openings 15'' for discharging the coating solution C therethrough. It should be noted here that in the above described nozzle 4B of the modification of FIGS. 12(*a*) and 12(*b*), the coating solution C is applied onto the molding surface at a predetermined angle as compared with the nozzles 4 and 4A of FIGS. 6 to 9 and FIGS. 10(*a*) to 10(*d*) wherein the coating solution is applied in a direction at right angles to the molding surface. So the direction of the application of the coating solution is not limited to be perpendicular to the molding surface but may be applied at any angle to the molding surface as long as the coating solution is effectively applied onto the molding surface to suit the purpose of the present invention.

It is to be noted here that the thickness of the mold coating formed on the molding surface through application of the coating solution by the above described nozzles 4, 4A or 4B should preferably be 0.4 to 3mm.

With the employment of the applicator nozzle 4A of the invention of FIGS. 10(*a*) to 10(*d*), the present inventors carried out a series of experiments as described hereinbelow so as to provide a method for applying a coating solution onto the molding surface of the metal mold without formation of any spiral pattern on the mold casting even when a thick mold coating is to be formed with the use of coating solution having high viscosity. Such applying method is characterized in that the digging up of a preceding mold coating by drops of coating solution subsequently applied thereto as experienced in the conventional applying method is eliminated. This is achieved by completing the application of the coating solution onto the metal mold through a one way movement of the applicator nozzle at a predetermined constant speed into the mold. The increased discharge amount of the coating solution is jetted from the applicator nozzle in a rod-like configuration, thus producing uniform mold coating having even thickness without formation of the spiral pattern thereon.

Figure 11:
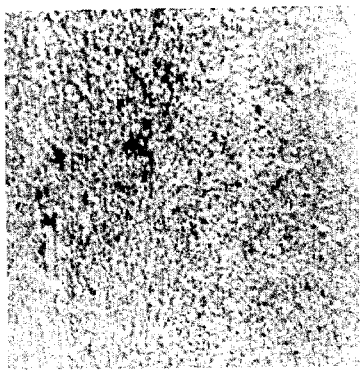
FIG. 11 is a photograph showing with the life-size surface of a mold surface produced by use of the applicator nozzle and coating solution applying method according to the invention, and FIGS. 12(*a*) and 12(*b*) are similar views to FIGS. 10(*a*) to 10(*b*), but particularly shows modification thereof.

Referring to FIG. 11 and also back to FIG. 5 and FIGS. 10(*a*) to 10(*d*), according to the applying method of the invention, the applicator nozzle 4A which has one nozzle opening or a plurality of nozzle openings 15' arranged in a one way direction of movement of the lance 3 i.e., the nozzle 4A at predetermined constant speed is employed for discharging the coating solution in rod-like form toward the molding surface 1*a*. In such a case, the approximate number of the nozzle openings 15' is determined depending on the moving speed of the lance 3 i.e., the nozzle 4A as tabulated below.

| lance speed (sec/m) | number of nozzle openings |
|---|---|
| 10 and over | 1 to 3 |
| 10 to 4 | 2 to 4 |
| 7 to 2 | 3 to 5 |
| 5 to 0.1 | 4 and over |

In the above described applying method of the coating solution of the invention, the distance or pitch P between the nozzle openings 15' is given by the equation, $$P = (6000/NXY) \text{ (cm)}$$

wherein $N$ is the number of revolution of the metal mold 1 in r.p.m., $X$ is the number of the nozzle openings 15' and $Y$ is the moving speed of the lance 3 in sec/m, by which arrangement, uniform mold coating without any spiral pattern thereon can be formed even if the coating solution flows only a distance of several millimeters along the molding surface 1*a* of the metal mold 1. The diameter of each nozzle opening 15' is so determined as to obtain the mold coating of desired thickness by one way movement of the nozzle 4A into the metal mold 1, according to the number of nozzle openings, the viscosity of the coating solution and pressure under which the coating solution is delivered. The diameter should preferably be within the range of 0.2 to 5mm under ordinary conditions.

Experiment I

Figure 3A:
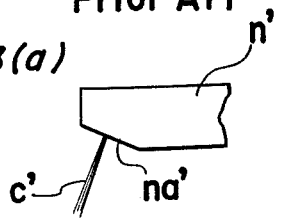
Prior Art FIG. 3(a)
FIGS. 3(*a*) and 3(*b*) represent another embodiment of a known prior art nozzle.
Figure 3B:
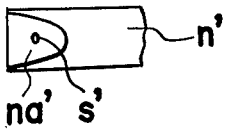

The application of the coating solution onto the molding surface 1*a* of the metal mold 1 was carried out under the following conditions with the use of the known applicator nozzle *n'* shown in FIG. 3 having a nozzle diameter of 2mm.

| | |
|---|---|
| (a) number of revolutions of the metal mold 1 | 993 r.p.m. |
| (b) moving speed of the lance 3 (i.e.nozzle 4A) | 6 sec/m |
| (c) viscosity of the coating solution | Zahn cup 23 sec |
| (d) delivering pressure for the coating solution | 2 kg/cm$^2$ |
| (e) number of coating solution applications | 2 times |

Figure 4:
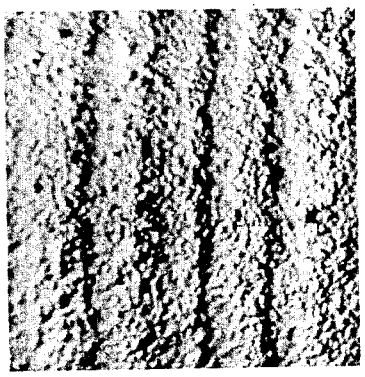
FIG. 4 is a photograph showing of a mold coating produced by the prior art devices.

Under the conditions described above, the spiral pattern as shown in FIG. 4 was noticed on the surface of the casting after centrifugal casting.

Experiment II

The application of the coating solution onto the molding surface of the metal mold was carried out under the following conditions with the use of an applicator nozzle 4A of the invention as shown in FIGS. 10(*a*) to 10(*d*) having three nozzle openings 15' each 3mm in diameter.

| | |
|---|---|
| (a) number of revolutions of the metal mold 1 | 993 r.p.m. |
| (b) moving speed of the lance 3 (i.e. nozzle 4A) | 6 sec/m |
| (c) viscosity of the coating solution | Zahn cup 23 sec |
| (d) delivering pressure for the coating solution | 2 kg/cm$^2$ |
| (e) number of coating solution applications | 1 time |

Under the conditions as shown above, uniform mold coating was obtained, with the casting surface after cetnrifugal casting being free from the spiral pattern as shown in FIG. 11.

As is clear from the foregoing description, according to the coating solution applying method of the invention, a thick mold coating having a uniform surface free from any spiral pattern can be obtained even when a thick mold coating is formed with a coating solution having high viscosity.

Experiment III

The application of the coating solution onto the molding surface of the metal mold was carried out under the following conditions with the use of an applicator nozzle 4A of the invention as shown in FIGS. 10(*a*) to 10(*d*) having two nozzle openings 15' each 1.5mm in diameter with a pitch of 5mm between the openings 15'.

| | |
|---|---|
| (a) number of revolutions of the metal mold 1 | 993 r.p.m. |

-continued

| | |
|---|---|
| (b) moving speed of the lance 3 (i.e. nozzle 4A) | 6 sec/m |
| (c) viscosity of the coating solution | Zahn cup 23 sec |
| (d) delivery pressure for the coating solution | 3 kg/cm$^2$ |
| (e) number of coating solution applications | 1 time |

Under the conditions as described above, uniform mold coating similar to that in Experiment II was obtained, with surface of casting after centrifugal casting being free from the spiral pattern.

It should be noted here that, although the above Experiments II and III were described with reference to the applicator nozzle 4A of the invention of FIGS. 10(*a*) to 10(*d*), exactly the same result can of course be obtained with the use of the applicator nozzle 4 of the invention of FIGS. 6 to 9.

As is clear from the foregoing description, according to the method for application of the coating solution of the invention, the coating solution is discharged onto the molding surface in the direction perpendicular to the latter through a plurality of nozzle openings formed, at a predetermined pitch to each other, in said applicator nozzle. The amount of the coating solution of high viscosity to be discharged in rod-like form through the nozzle openings is increased so as to be sufficient to complete the mold coating in a one way movement of the applicator lance at a predetermined constant speed into the metal mold. Thus the disadvantages inherent in the conventional applicator nozzles, such as the digging-up of the preceding or previously formed mold coating by drops of coating solution subsequently applied thereto, is advantageously prevented, with consequent elimination of the formation of an undesirable spiral pattern in the mold coating.

Although the present invention has been fully described by way of example with reference to the attached drawings, it is to be noted that various changes and modifications are apparent to those skilled in the are therefore, unless such changes and modifications depart from the scope of the present invention, they should be construed as included therein.

What is claimed is:

1. A method for applying a coating solution onto a molding surface of a metal mold in a centrifugal casting operation wherein the coating solution is applied onto a molding surface of a rotating metal mold for formation of a mold coating on the molding surface through a nozzle, which method comprises linearly moving the nozzle in a direction parallel to the rotating axis of the metal mold, from one end to the other end of said metal mold which is being rotated, while discharging the coating solution from a plurality of nozzle openings formed in said nozzle for forming the mold coating on the molding surface as the nozzle moves in said linear direction into the metal mold, said nozzle openings being at a predetermined pitch to each other such that the pitch between the nozzle openings is given by the equation:

$$P = (6000/NXY) \text{ (cm)}$$

whrein $P$ is the pitch between the nozzle openings, $N$ is the number of revolutions of the metal mold in r.p.m., $X$ is the number of nozzle openings and $Y$ is the moving speed of the lance in sec./m. by which relationship a uniform coating can be applied wthout any spiral patterns on the surface of the metal mold.

2. A method for applying a coating solution onto a molding surface of a metal mold in centrifugal casting operation wherein the coating solution is applied onto a molding surface of a rotating metal mold for formation of a mold coating on the molding surface through an applicator nozzle mounted on an applicator lance as the applicator lance advances into the metal mold, which comprises employment of a coating solution having high viscosity, discharging said coating solution onto the molding surface through a pluraity of nozzle openings formed, at a predetermined pitch to each other in said applicator nozzle, and increasing the amount of said coating solution to be discharged from said applicator nozzle of such a extent as to form a thick mold coating on the molding surface through said linear movement of said applicator lance at a predetermined constant speed into the metal mold, said predetermined pitch between the nozzle openings being given by the equation:

$$P = (6000/NXY) \text{ (cm)}$$

wherein $P$ is the pitch between the nozzle openings, $N$ is the number of revolutions of the metal mold in r.p.m., $X$ is the number of nozzle openings and $Y$ is the moving speed of the lance in sec./m. by which relationship a uniform coating can be applied without any spiral patterns on the surface of the metal mold.

3. A method according to claim 2, wherein the nozzle openings are located in a position facing the metal mold so that the coating solution is discharged in a direction which is perpendicular to the molding surface as well as perpendicular to the linear direction of the movement of the nozzle.

4. A method according to claim 3 wherein the nozzle openings are located in two rows on the surface of the nozzle such that the rows extend in a direction parallel to the rotating axis of the metal mold, one of the rows being arranged such that each of the nozzle openings are staggered between the nozzle openings of the other row.

* * * * *